US005271351A

United States Patent [19]

Horiuchi et al.

[11] Patent Number: 5,271,351

[45] Date of Patent: Dec. 21, 1993

[54] AUTO-SAILING SYSTEM

[75] Inventors: Kohtaroh Horiuchi; Tsuide Yanagihara; Atsushi Uchiyama, all of Iwata, Japan

[73] Assignee: Yamaha Hatsudoki Kabushiki Kaisha, Japan

[21] Appl. No.: 829,257

[22] Filed: Feb. 3, 1992

[30] Foreign Application Priority Data

Feb. 6, 1991 [JP] Japan ..... 3-035101

[51] Int. Cl.[5] ..... B63H 9/06

[52] U.S. Cl. ..... 114/106; 114/102; 254/336

[58] Field of Search ..... 114/102, 103, 104, 105, 114/106, 107; 254/272, 273, 374, 335, 336

[56] References Cited

U.S. PATENT DOCUMENTS 4,149,482 4/1979 Hoyt ..... 114/106

FOREIGN PATENT DOCUMENTS 3731022 5/1988 Fed. Rep. of Germany ..... 114/102
3644685A1 7/1988 Fed. Rep. of Germany .
2561613 9/1985 France .
2586396 2/1987 France .
2593772 8/1987 France ..... 114/102
48106 6/1981 U.S.S.R. ..... 254/374
WO87/01346 3/1987 World Int. Prop. O. .

OTHER PUBLICATIONS

Abstract of Japanese Published Patent Application No. 62-1691, *Patent Abstracts of Japan,* 1987 (Publication No. 60-139768).

*Primary Examiner*—Michael S. Huppert
*Assistant Examiner*—Thomas J. Brahan
*Attorney, Agent, or Firm*—Bacon & Thomas

[57] ABSTRACT

A system for automatically causing a flexible sail to be brought to its optimum position with respect to the wind direction includes a sail holding member installed on the front of the hull and rope winders installed at rear portions of the hull, a flexible sail having its front end attached to the sail holding member and its rear end tied to the ropes wound on the winders, a wind direction detector for detecting wind direction, and a control unit which determines rope winding amounts on the basis of an output from the wind direction detector, and which actuates the rope winders on the basis of the determined values.

11 Claims, 9 Drawing Sheets

FIG. 10

| | NO | State/Operation | Rope Winder 4L | | Rope Winder 4R | | Sail Winder 3 | |
|---|---|---|---|---|---|---|---|---|
| | | | Counter Value | Motor M2 | Counter Value | Motor M2 | Counter Value | Motor M1 |
| Stable State | 1 | Auto Standby | L1 | OFF | R1 | OFF | F1 | OFF |
| | 2 | Half Sail | L2 | mode C | R2 | mode C | F2 | OFF |
| | 3 | Starboard Hold | L3 | OFF | R3 | OFF | F3 | OFF |
| | 4 | Port Hold | L4 | OFF | R4 | OFF | F4 | OFF |
| Transient State | 5 | Sail Paying Half | L1→L2 | mode C | R1→R2 | mode C | F1→F2 | Positioning Servo |
| | 6 | Starboard Sail Stretch | L2→L3 | mode d | R2→R3 | mode a | F2→F3 | ↓ |
| | 7 | Starboard Hold→Half | L3→L2 | mode b | R3→R2 | mode c | F3→F2 | ↓ |
| | 8 | Port Sail Stretch | L2→L4 | mode a | R2→R4 | mode d | F2→F4 | ↓ |
| | 9 | Port Hold→Half | L4→L2 | mode c | R4→R2 | mode b | F4→F2 | ↓ |
| | 10 | Sail Winding | L2→L1 | mode b | R2→R1 | mode b | F2→F1 | ↓ |

AUTO-SAILING SYSTEM

BACKGROUND OF THE INVENTION

1. Field of the Invention

This invention relates to an auto-sailing system which automatically operates the sail of a sailing vessel according to the wind direction.

2. Description of Related Art

A variety of sailing vessels are known, including vessels having sails as the main propulsion device, and motor sailors provided with an internal combustion engine to provide propulsion in addition to that provided by the sail. The sails used in known sailing devices are usually flexible and made of cloth having one side supported by a mast, a stay or the like, and the other end tied by a rope, although rigid sails are also known. In general, a sailing vessel can sail in an arbitrary direction within a range of approximately 45° from the wind direction, directions outside that range being unsailable. However, even if the destination is in a direction which is outside the sailable range, the vessel can still reach the destination by tacking, i.e., by sailing in a direction within the sailable range, and then sailing in another direction within the sailable range, the two directions crossing the unsailable direct path to the destination.

A problem with conventional sailing vessels is that it is difficult to adjust the direction of the sail according to the wind direction in order to most effectively utilize the propulsion force provided by the wind, especially during a tacking operation when it is necessary to move the sail from one gunwale to another through a position in which the vessel is unsailable. Thus, operation of a sail on a sailing vessel requires considerable skill, and it is consequently generally necessary to provide both a sail operator and a helmsman. Automization of the sailing device, on the other hand, would enable optimum utilization of the wind, and also eliminate the need for a separate sail operator.

Although automization has been realized for vessels having sails of rigid structure, it has heretofore been impossible to automize vessels having flexible sails, which are adjusted by paying out or taking in the rope. Because the rope transmits nothing but tension, as opposed to sail position information, it is especially difficult to dispose of the rope when it is loosened due to unstable movement of the sail when the wind is not constant, or changes direction or speed. Also, the rope may twine around part of the hull (cabin or the like) if it is released too far while tacking. As a result, the operating force required for operating the rope varies widely according to the position of the sail, and according to the length of the rope taken-in or paid-out.

SUMMARY OF THE INVENTION

It is therefore an objective of the invention to take the above-mentioned problems into consideration and provide an auto-sailing system capable of automatically bringing a flexible sail to its optimum position with respect to the wind direction.

In order to achieve this objective, an auto-sailing system according to a preferred embodiment of the invention includes a sail holding member and rope winders installed on the front and rear portions of the hull, respectively; a flexible sail having its front end attached on the sail holding member and its rear end tied to the ropes wound on the rope winders; a wind direction detector for detecting the wind direction; and a control unit which determines the rope winding amounts and the winding rope paying amounts on the basis of the output of the wind direction detector, and which actuates the rope winders on the basis of those determined values.

The auto-sailing system of the preferred embodiment of the invention is further provided with a braking device for each of the rope winders which detects the tension of the ropes and, when the tension detected at one of the rope winders is smaller than a specified value, restricts release of rope from the respective rope winder.

According to the preferred embodiment of the invention, since the control unit calculates an optimum sail position from the information for the wind conditions, and automatically brings the sail to its optimum position by controlling the operation of the rope winders on the basis of the calculation result, sail operation can be automized on sailing vessels having a flexible sail. Even when the sail moves unstably because of wind turbulence or other situations and the rope is loosened, the rope is preventing from escaping the rope winder because the braking device is actuated and the rope is fixed when the rope tension becomes smaller than a specified value.

BRIEF DESCRIPTION OF THE DRAWINGS

FIG. 10 is a table listing the modes of the rope winders and the sail winder corresponding to each state/operation of a sail used in the auto-sailing system of the preferred embodiment of the invention.

DETAILED DESCRIPTION OF THE PREFERRED EMBODIMENTS

Figure 1:
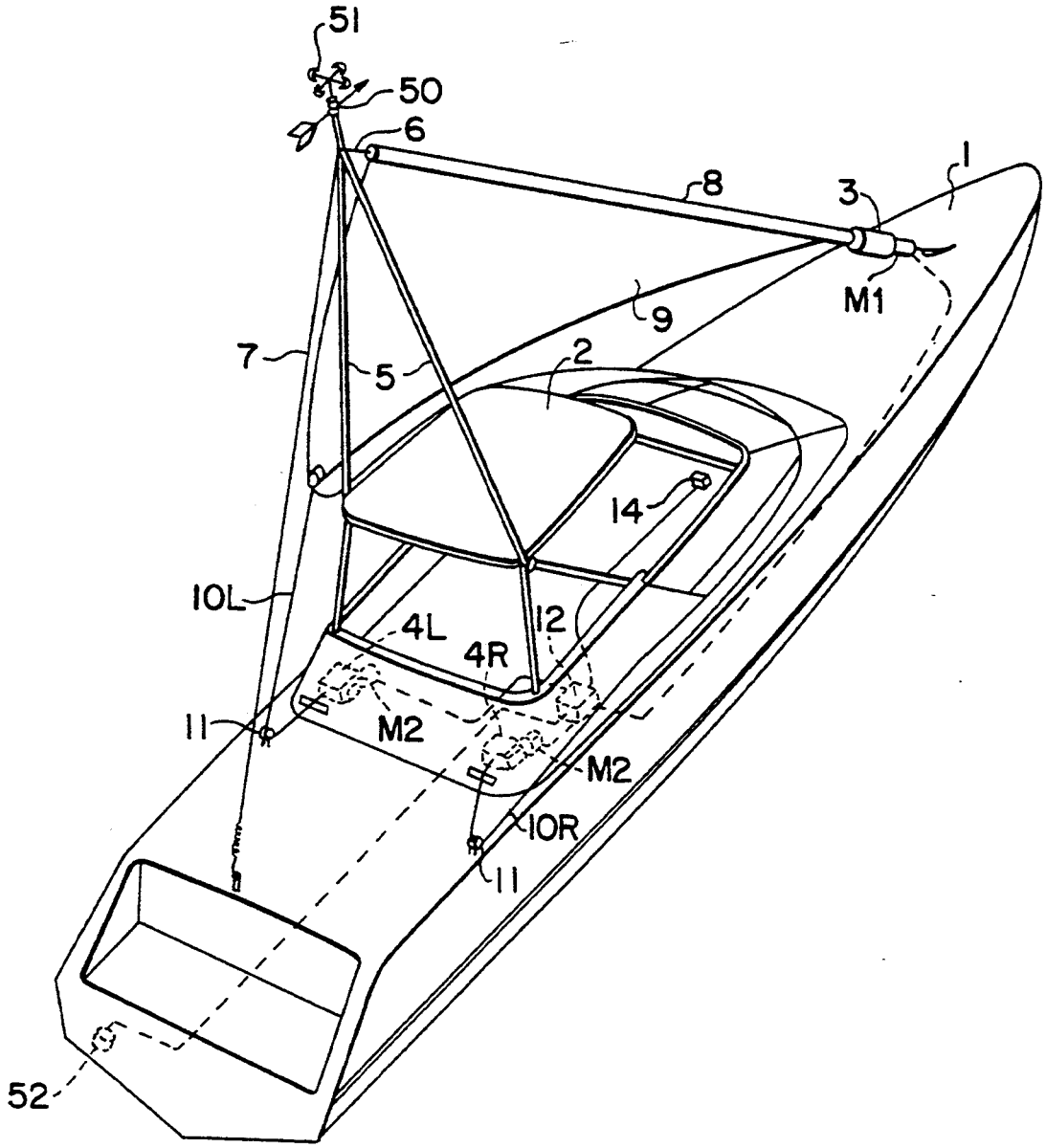
FIG. 1 is a perspective view of the sailing vessel provided with an auto-sailing system in accordance with a preferred embodiment of the invention.
Figure 2:
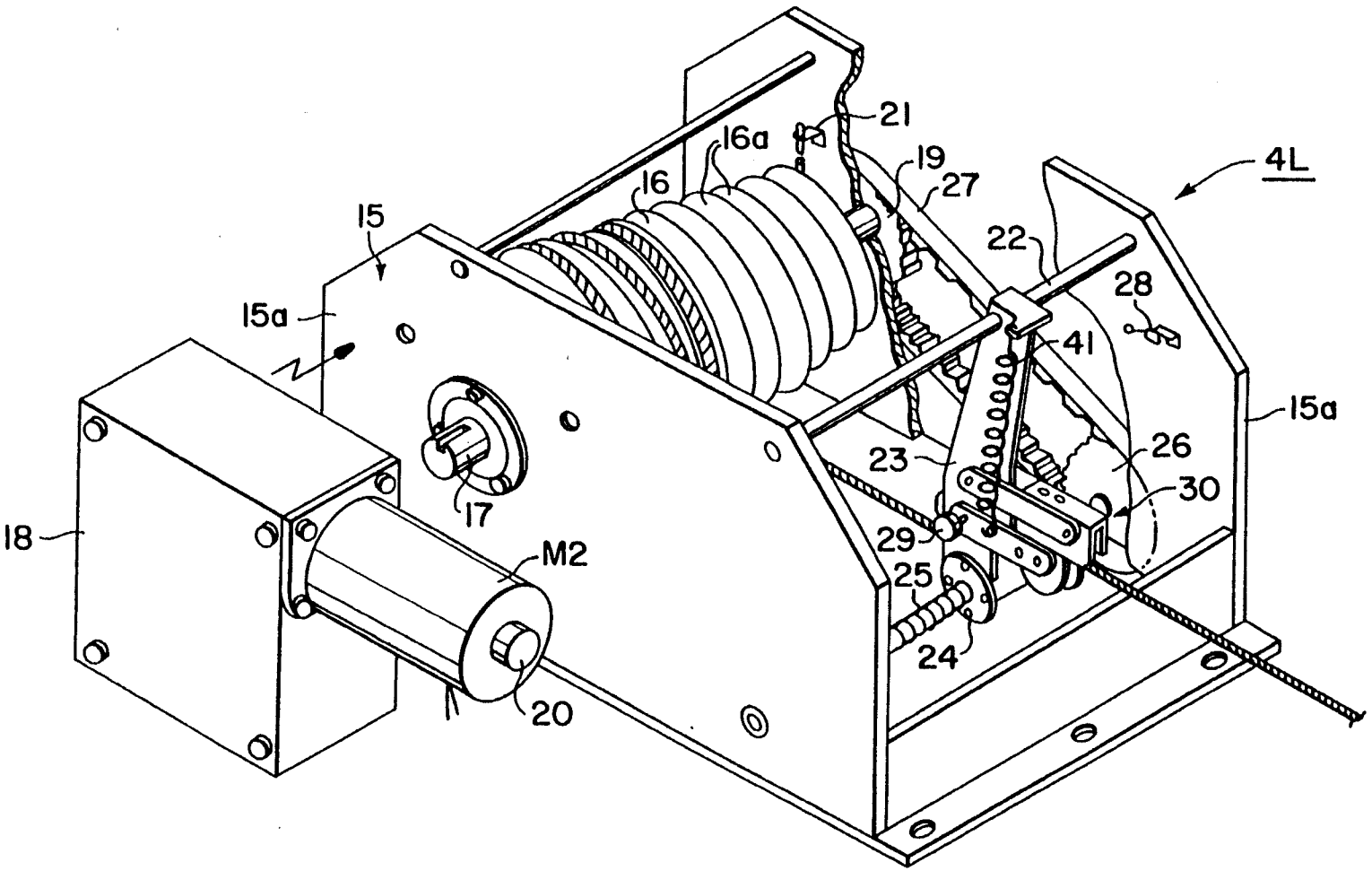
FIG. 2 is a partially broken-away perspective view of a rope winder which is part of the auto-sailing system of the preferred embodiment of the invention.
Figure 3:
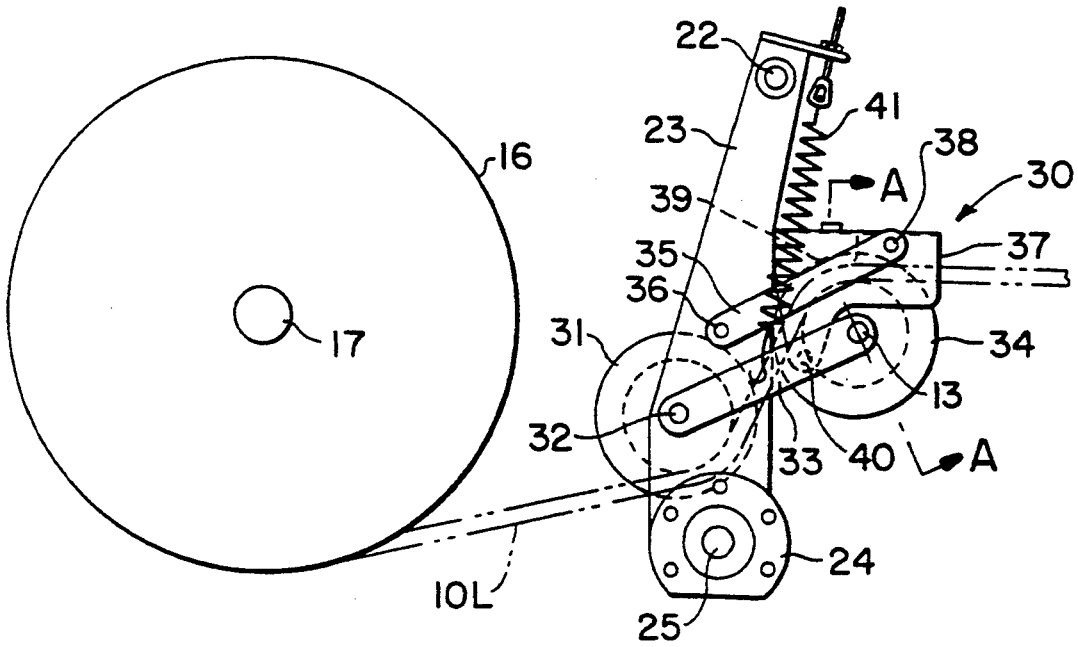
FIG. 3 is a side view of a braking device for use with the auto-sailing system of the preferred embodiment of the invention, the braking device being shown in a working (ON) state.
Figure 4:
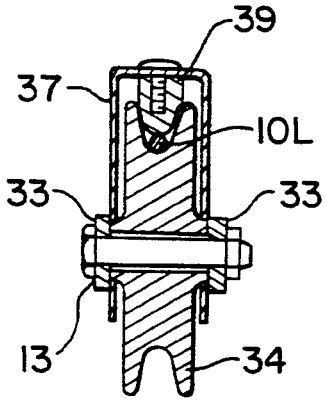
FIG. 4 is a sectional view taken along line A—A of FIG. 3.
Figure 5:
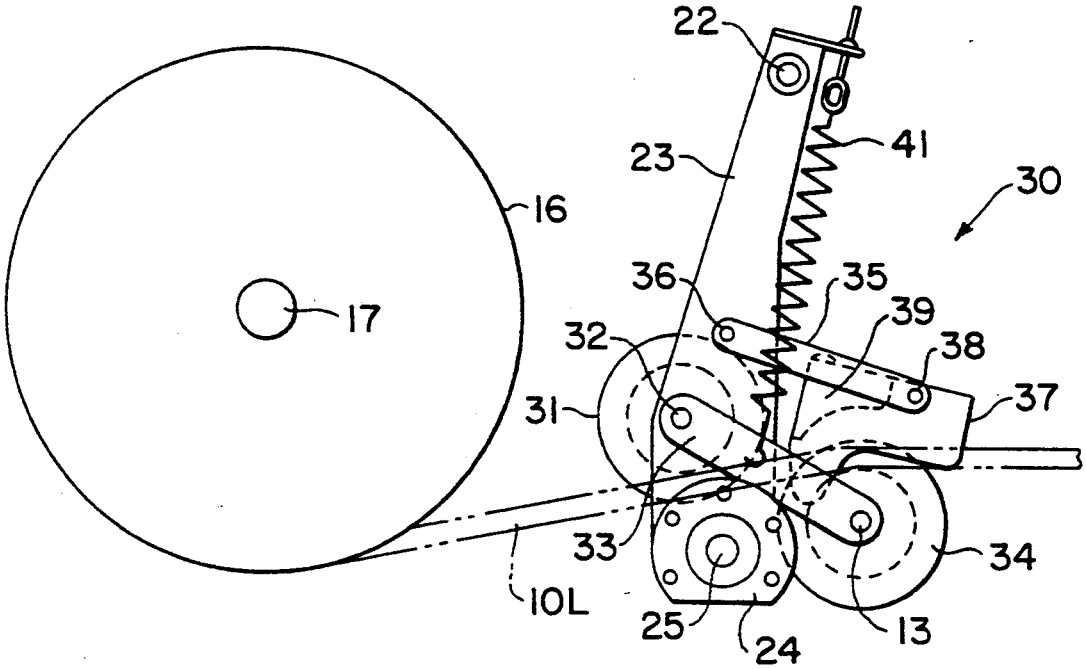
FIG. 5 is a side view similar to that of FIG. 3, but showing a non-working (OFF) state of the braking device.

FIG. 1 is a perspective view of a sailing vessel provided with an auto-sailing system according to a preferred embodiment of the invention. FIG. 2 illustrates a rope winder used in the auto-sailing system of FIG. 1, while FIGS. 3 and 5 are side views showing respective working (ON) and non-working (OFF) states of a braking device for use with the auto-sailing system of FIG. 1. FIG. 4 is a sectional view of the braking system illustrated in FIG. 3.

The sailing vessel of FIG. 1 will be described only insofar as relates to the claimed invention, the structure of a sailing vessel being well-known and the invention being applicable to a wide variety of sailing vessels. Hull 1 is provided with a cabin 2 at its middle, sail winders 3 at its front middle, and rope winders 4L and 4R at the left and right sides in a rear portion of cabin 2. On top of cabin 2 are two masts 5 which together with the roof of the cabin form a triangle. A wind direction detector 50 and wind speed detector 51 are mounted on the top of masts 5. Between the top of masts 5 and the front and rear ends of hull 1 are stretched a forestay 6 and backstay 7, respectively, for supporting masts 5.

A sail winder 3 is installed coaxially with the forestay 6, and includes a cylindrical shaft 8 which rotates about the forestay. One side of a sail 9 made of a flexible material such as cloth is attached to shaft 8. Sail 9 may either be wound around shaft 8 or unwound from shaft 8 according to the direction of rotation of the shaft. Shaft 8 is rotatably driven by motor M1 of sail winder 3.

The rear apex of sail 9 is tied with the extended ends of ropes 10L and 10R. Ropes 10L and 10R are wound around rope winders 4L and 4R, respectively. The ropes are guided by respective pulleys 11.

Sail winder 3 and rope winders 4L and 4R are electrically connected to a control unit 12 installed near the middle of hull 1. The wind direction detector 50, wind speed detector 51 and a vessel speed detector 52 installed on the rear end lower portion of the hull 1 are also electrically connected to the control unit 12, which is in turn is connected to an operation switch 14 installed in cabin 2.

Referring to FIGS. 2–4, the structure of rope winder 4L will now be described. Rope winder 4R is identical to rope winder 4L, and thus is detailed description has been omitted.

As shown in FIG. 2, a case 15 between sidewalls 15*a* is arranged to rotatably support a conical winding drum 16 via a main shaft 17. A motor M2 is connected to one end of main shaft 17 through worm reduction gearing 18, and the other end of main shaft 17 is fastened to a toothed pulley 19. Conical winding drum 16 includes a groove 16*a* helically formed around the drum. Rope 10L is wound around the conical winding drum 16 along groove 16*a*. Motor M2 includes a rotary encoder 20 for detecting the rotation speed of the motor. An access sensor 21 detects the zero point (rotation starting point) of the conical drum 16 and is fixed on an inside surface of one sidewall 15*a* of the case adjacent conical winding drum 16.

A slider 23 is axially slidably supported on a slide shaft 22 which spans both sidewalls 15*a* through the upper end portion of case 15. Ball screw nuts 24, only one of which is shown, are fastened on the lower end portion of slider 23, and a ball screw 25 which rotatably spans both sidewalls 15*a* is screwed and inserted into ball screw nuts 24. A toothed pulley 26 is fastened on one end of ball screw 25, and an endless toothed belt 27 is wound around toothed pulley 26 and toothed pulley 19. A limit switch 28 is installed on the inside of each sidewall 15*a*.

Slider 23 is provided with a braking device 30 for restricting the paying out of the rope 10L. Referring to FIGS. 3 and 4, a pulley 31 is rotatably supported on slider 23 through a shaft 32. Respective first ends of links 33 are fastened on both ends of the shaft 32. A pulley 34 is rotatably supported on the other ends of links 33 through a shaft 13. A potentiometer 29 for measuring the rope tension is fastened on one end portion of shaft 32, as is best shown in FIG. 2.

Links 35, only one of which is shown, are provided above links 33. One end of each link 35 is rotatably supported on slider 23 through a shaft 36. A shoe holder 37 formed like a channel opened downward is rotatably supported on the other end of each link 35 through a shaft 38. The shoe holder 37 holds a brake shoe 39 inside the channel, and is also rotatably supported on the links 33 through a shaft 40.

An end portion of rope 10L which extends from the portion wound around conical winding drum 16 is wound around pulleys 31 and 34 as shown in FIG. 3. Pulley 34 is urged counterclockwise by a tension spring 41 mounted in an elongated position between link 33 and slider 23.

The state of the braking device 30 as shown in FIGS. 3 and 4 is an ON state. The ON state results when rope 10L is loosened and the tension on it becomes smaller than a specified value, causing links 33 to be swung counterclockwise by the pulling force of the spring 41, and the pulley 34 also to be swung counterclockwise, thereby catching rope 10L between the brake shoe 39 and pulley 34. Therefore, in the ON state, the paying of the rope 10L is restricted and rope 10L is prevented from falling off the groove of the conical winding drum 16 despite the loosening which has occurred. On the other hand, during the OFF state shown in FIG. 5, the tension on rope 10L causes pulley 34 and links 33 to rotate against the force of spring 41, moving pulley 34 away from brake shoe 39 and freeing the rope to pay out.

Figure 6:
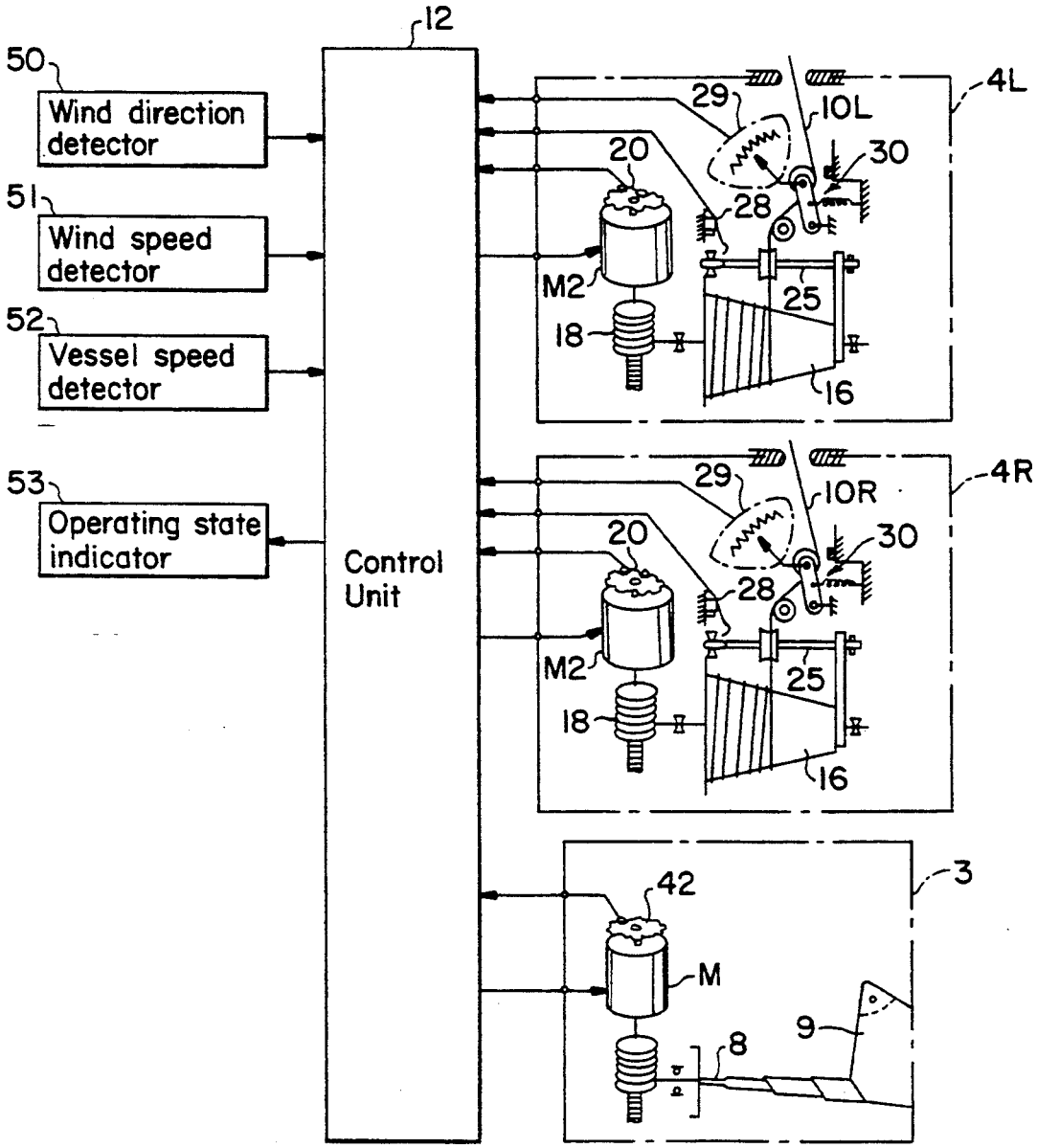
FIG. 6 is a block diagram showing the structure of an actuation and control system for the auto-sailing system of the preferred embodiment.

FIG. 6 shows the structure of an actuation and control system for the auto-sailing system of the preferred embodiment. Rotary encoders 20, limit switches 28, and potentiometers 29 which are provided for both rope winders 4L and 4R, while rotary encoder 42 is mounted on motor M1 for the sail winder 3. Encoders 20, switches 28, potentiometer 29, and encoder 42 are all electrically connected to control unit 12. Also connected to control unit 12 is an operating state indicator 53 installed on an operation panel in cabin 2.

The auto-sailing system shown in FIGS. 1–6 operates as follows:

Before the auto-sailing system is started, sail 9 is wound around the shaft 8 of the sail winder, and the left and right ropes 10L and 10R are unwound from the rope winders 4L and 4R, respectively, such that only a small length of ropes 10R and 10L remains wound around the larger diameter portions of the respective conical winding drum 16. At this time, since no tension works on ropes 10L and 10R, braking devices 30 provided on each winder 4L and 4R are in an ON state, and ropes 10L and 10R are caught and secured between brake shoe 39 and pulley 34.

When the auto-sailing system is started by turning on operation switch 14 shown in FIG. 1, the signal data for wind direction, wind speed and vessel speed detected respectively by wind direction detector 50, wind speed detector 51, and vessel speed detector 52, are inputted to control unit 12, which determines an optimum position of the sail 9 based on the inputted data, and operates the sail winder 3 and rope winders 4L and 4R according to these determined values. Those skilled in the art will appreciate that the relationship between optimum sail position and wind direction depends on a variety of factors, but that the relationship may nevertheless be predetermined by estimation or experimentation. The relationship may take the form of a look-up table or mathematical algorithm but, once determined, it is easily programmed into control unit 12 to operate the system as described below, using the above-described system hardware.

Figure 7:
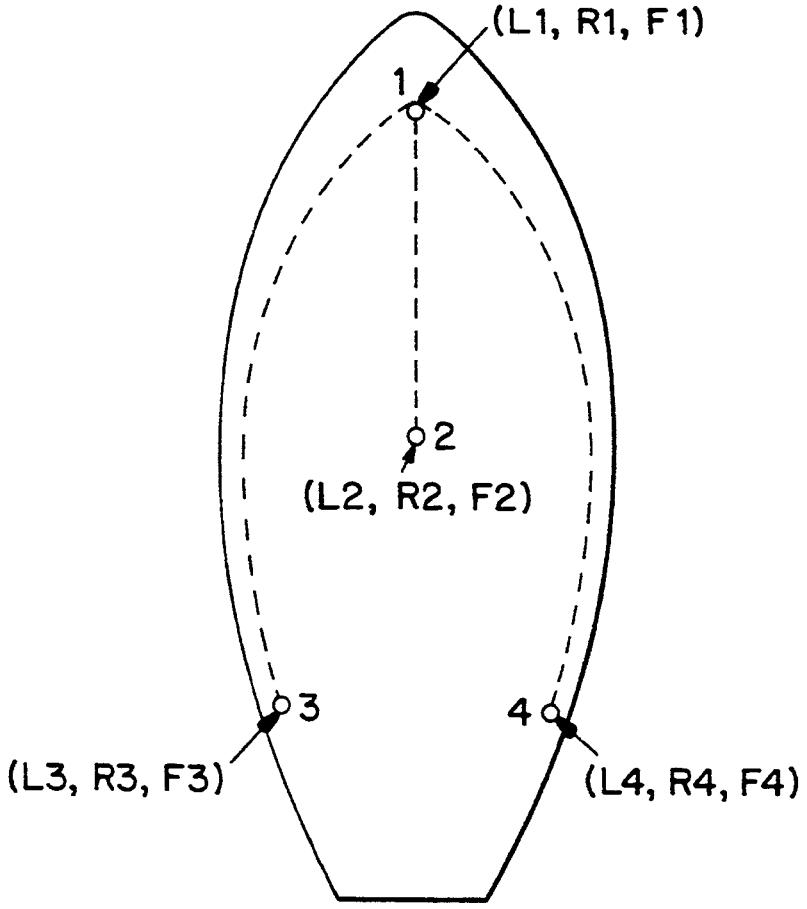
FIG. 7 is a schematic diagram illustrating the coordinates of the clew.

FIG. 7 shows the coordinates of the clew. In this illustration, points 1(L1, R1, F1), 2(L2, R2, F2), 3(L3, R3, F3), and 4(L4, R4, F4) are the coordinates of the rear end portion of sail 9 in its state of "auto-standby", which is the state before starting auto-sailing. The rear end portion of the sail 9 is the portion which is tied to ropes 10L and 10R. Numeral 2 designates the half sail position in which the sail is half unwound, numeral 3 designates the starboard hold position in which the sail is set on the port side of the boat, and numeral 4 designates the port hold position in which the sail is set on the starboard side. Letters L, R, and F show counter values of the rope winders 4L and 4R and the sail winder 3 respectively, i.e., the counter values of rotary encoders 20, 20, and 40, in proportion to the winding amount and paying amount of the ropes 10L and 10R and the sail 9.

Figure 8:
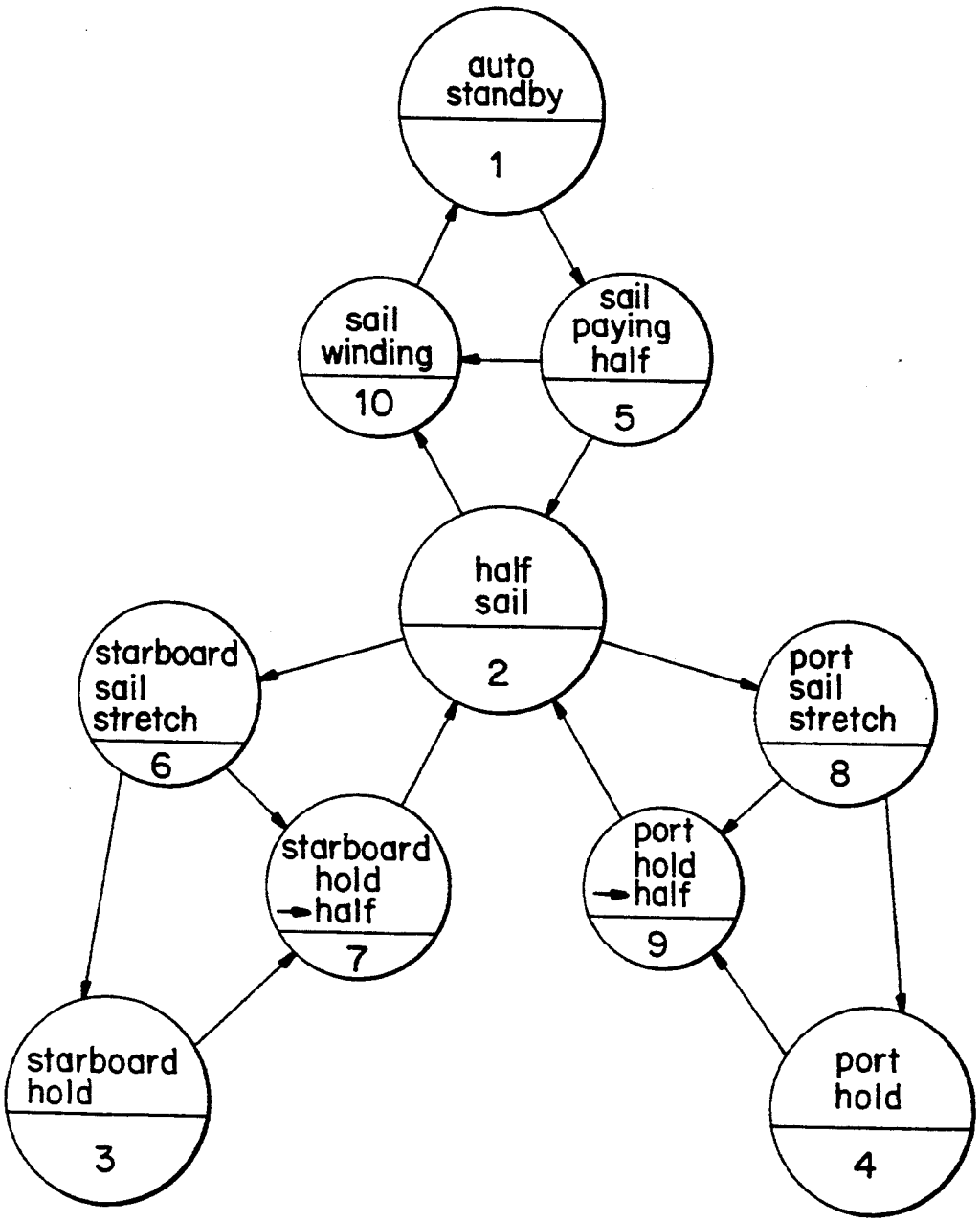
FIG. 8 is a mode transition diagram of the ropes, rope winders, and sail winder for the auto-sailing system of the preferred embodiment of the invention.
Figure 9:
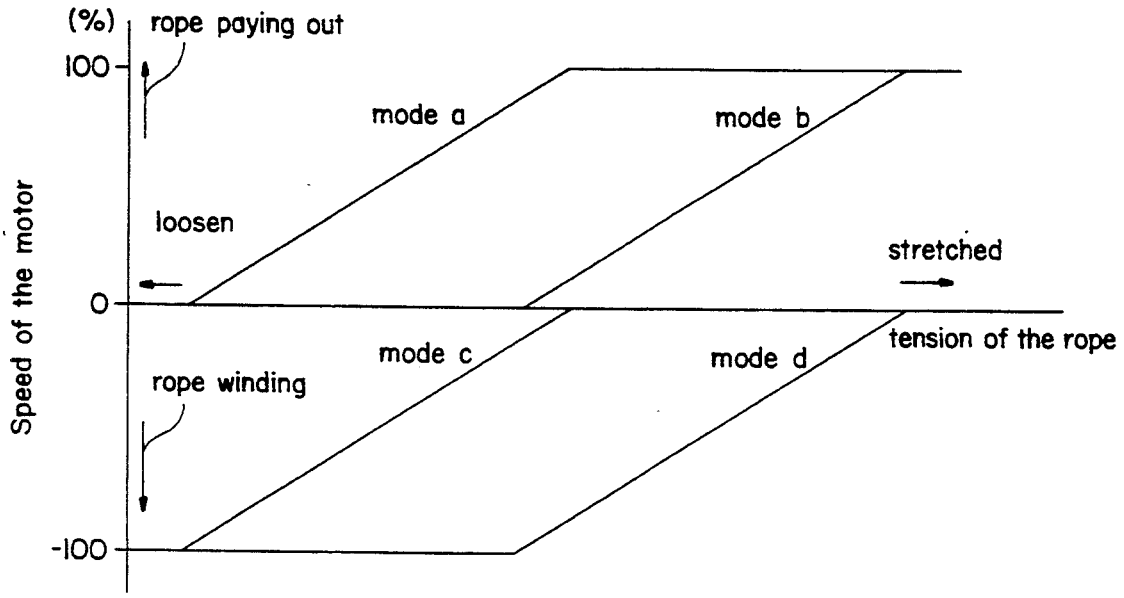
FIG. 9 is a graph illustrating the speed modes of the motors of the rope winder of the preferred embodiment of the invention, versus the tension working on the ropes.

FIG. 8 is a mode transition diagram for ropes 10L and 10R, rope winders 4L and 4R, and sail winder 3, and numerals 1–10 in FIG. 8 correspond to numerals 1–10 in the table of FIG. 10, described below. Further, FIG. 9 shows the speed modes a–d of motors M2 of rope winders 4L and 4R, as a function of the tension working on ropes 10L and 10R.

At auto standby state 1, having coordinates (L1, R1, F1), in which the auto-sailing system is not started yet, all motors M1 and M2 are in the inoperative state, as shown in FIG. 10.

The case where the mode undergoes a transition from the auto standby state 1 (L1, R1, F1) to the starboard hold state 3 (L3, R3, F3) is as follows: as shown in FIG. 8, the mode changes to the half sail state 2 (L2, R2, F2), which is a stable state, through the sail paying half state 5 (L1→L2, R1→R2, F1→F2), which is a transient state. In sail paying half state 5, motors M2 of the rope winder 4L and 4R are simultaneously actuated along the mode line c shown in FIG. 9, and the ropes 10L and 10R are wound by a specified amount, while the motor M1 of the sail winder 3 is actuated using a positioning servo, and the sail 9 is thus paid out by a specified amount from the shaft 8 until the mode reaches the half sail state 2 (L2, R2, F2).

For example, when the motor M2 is actuated in the rope winder 4L as described above, conical winding drum 16 shown in FIG. 2 is rotated and a tension larger than a specified value works on rope 10L. Therefore, links 33 and pulley 34 are swung clockwise around shaft 32 against the tension force of spring 41. Consequently, braking device 30 is turned off and the rope 10L is released from being caught between brake shoe 39 and pulley 34 and rope 10L is wound by the conical winding drum 16. Since the rotation of conical winding drum 16 is transmitted to ball screw 25 through toothed pulley 19, toothed bell 27, and toothed pulley 26, the ball screw 25 is rotated. Consequently, slider 23 moves axially along slide shaft 22, and thus pulleys 31 and 34 supported on slider 23 move in the same direction. As a result, rope 10L is wound under the guidance of pulleys 31 and 34 along groove 16A on conical winding drum 16 without overlapping.

While winding, the tension force working on rope 10L is detected by potentiometer 29, and a signal from potentiometer 29 is inputted to control unit 12, based on which the control unit controls the speed of motor M2 of rope winder 4L along the mode line c of FIG. 9 to prevent the winding speed of rope 10L from becoming larger than the paying speed of sail 9, and thus prevent excessive tension force from working on sail 9.

Although the description above is for the winding operation of one of the rope winders 4L, it will be appreciated that the winding operation of the other rope winder 4R is the same as described above.

The mode transition from auto-sailing standby state 1 to starboard hold state 3 also goes through starboard sail stretch state 6 (L6, R6, F6), which is a transient state, when changing from the half sail state 2 (L2, R2, F2) to the starboard hold state 3 (L3, R3, F3), as shown in FIG. 8. Motor M2 of one rope winder 4L is actuated along mode line d shown in FIG. 9 to wind rope 10L in the starboard sail stretch state 6 while, in connection with this movement, motor M2 of the other rope winder 4R is actuated along the mode line a shown in FIG. 9, and the rope 10R is payed out by a specified amount from the rope winder 4R. Simultaneously, sail winder 3 is actuated and sail 9 is payed out by a specified amount, at which time the mode reaches starboard hold state 3 (L3, R3, F3), which is a stable state.

When the mode changes from the starboard hold state 3 to the port hold state 4 (L4, R4, F4) during a tacking operation, it necessarily goes through the half sail state 2 (L2, R2, F2). This is for the purpose of avoiding interference of sail 9 with cabin 2 (See FIG. 1). As shown in FIG. 8, to get from the starboard hold state 3 to half sail state 2 requires the sail to go through the starboard hold→half state 7 (L3→L2, R3→R2, F3→F2), which is a transient state. At the starboard hold→half state 7, the motor M2 of one rope winder 4R is actuated along mode line c shown in FIG. 9 to wind rope 10R while, in connection with this action, motor M2 of the other rope winder 4L is actuated along mode line b of FIG. 9 and rope 10L is payed out by a specified amount from rope winder 4L. Simultaneously, sail winder 3 is actuated to wind sail 9 by a specified amount, and the mode reaches half sail state 2 (L2, R2, F2), which is a stable state.

Thereafter, the mode transition reaches the port hold state 4 (L4, R4, F4), a stable state, through the port sail stretch state 8 (L2→L4, R2→R4, F2→F4), which is a transient state. At the port sail stretch state 8, motor M2 of rope winder 4R is actuated along mode line d shown in FIG. 9 to wind rope 10R while, in connection with this action, motor M2 of the other rope winder 4L is actuated along mode line a of FIG. 9 and rope 10L is payed out by a specific amount from rope winder 4L. Simultaneously, sail winder 3 is actuated to pay out sail 9 by a specified amount, and the mode reaches port hold state 4 (L4, R4, F4), which is a stable state.

In the case where the sail 9 is wound after returning from port hold state 4 to auto standby state 1, after the mode transition has reached half sail state 2 through port hold→half state 9 as shown in FIG. 8, the mode reaches auto standby state 1 through sail winding state 10. At sail winding state 10, since the motors M2 of both rope winders 4L and 4R are simultaneously actuated along mode line b of FIG. 9, as shown in FIG. 10, ropes 10L and 10R are payed out while the sail winder 3 is actuated to wind the sail 9 around the shaft 8.

As described above, because the control unit 12 in this embodiment calculates the optimum position of the sail 9 from information about wind condition, and controls the actuation of sail winder 3 and rope winders 4L and 4R on the basis of this calculation result to bring the sail 9 to its optimum position automatically, the operation of the sail 9 can be automated even on a sailing vessel having a flexible sail. Even when ropes 10L and 10R are loosened because of unstable movement of sail 9 caused by wind turbulence or the like, since the motor M2 is inactuated, and the braking device 30 works to fix ropes 10L and 10R if the tension of ropes 10L and 10R becomes smaller than a specified value, ropes 10L and 10R are prevented from falling off of groove 16A of conical winding drum 16.

As is clear from the above description, since the auto-sailing system according to the preferred embodiment invention is provided with a sail holding member and rope winders installed on the front and rear portions of the hull respectively, a flexible sail having its front end attached on the sail holding member and its rear end tied to the ropes wound on the winders, a wind direction detector for detecting wind direction, and a control unit which determines the rope winding amounts and the rope paying amounts on the basis of the output of the wind direction vector, and actuates the rope winders on the basis of these determined values, the flexible sail can automatically be brought to its optimum position with respect to wind direction and it is therefore possible to automate the operation of the flexible sail. It will of course be appreciated, on the other hand, that a variety of modifications may be made to the invention as described above, and it is intended that all such modifications be included within the scope of the invention to the extent permitted by the prior art. Accordingly, it is intended that the invention not be limited to the above description, but rather that it be defined solely by the appended claims.

We claim:

1. An auto-sailing system comprising:

a flexible sail having one end attached to a sail holding member and another end tied to at least one rope having a first rope end;

rope winder means including first and second rope winders, said first rope end being wound around said first rope winder and a second rope end being wound around said second rope winder, for taking in and paying out said at least one rope to control a position of said sail;

a wind condition detector for detecting a wind condition; and a control unit including means for determining rope winding and rope paying amounts in response to an output from said wind condition detector by actuating said rope winders on the basis of the determined rope winding and rope paying amounts.

2. An auto-sailing system as claimed in claim 1, wherein each said rope winder comprises a rotatably mounted conical drum having a helical groove for receiving the rope when the rope is wound around said drum, and a motor arranged to rotate the drum in response to commands from said control unit to pay out or take in the rope.

3. An auto-sailing system as claimed in claim 2, wherein said rope winder comprises means for measuring rope tension and generating a signal indicative of the rope tension, means in said control unit responsive to said rope tension, and means for controlling the motor speed based upon the detected rope tension to follow a selected mode line, said mode line being selected in response to the output from said wind condition detector.

4. An auto-sailing system as claimed in claim 3, wherein said tension measuring means comprises a potentiometer mounted on a casing of said rope winder.

5. An auto-sailing system as claimed in claim 1, further comprising a sail winder which includes a servo controlled motor arranged to wind and unwind the sail around a shaft in response to signals from said control unit.

6. An auto-sailing system as claimed in claim 1, wherein said wind condition detector includes a wind direction detector.

7. An auto-sailing system as claimed in claim 6, wherein said wind condition detector further comprises a wind speed detector.

8. An auto-sailing system as claimed in claim 1, wherein said control unit is responsive to signals input from a vessel speed detector, a wind direction detector, a wind speed detector, two rope tension detectors, and an operation switch for actuating the control unit.

9. An auto-sailing system as claimed in claim 1, wherein said second rope winder is identical to the first rope winder.

10. An auto-sailing system comprising:

a flexible sail having one end attached to a sail holding member and another end tied to at least one rope;

rope winder means including a rope winder for taking in and paying out said rope to control a position of said sail;

a wind condition detector for detecting a wind condition; and a control unit including means for determining rope winding and rope paying amounts in response to an output from said wind condition detector by actuating said rope winder on the basis of the determined rope winding and rope paying amounts, wherein said rope winder includes a braking device, said braking device including means responsive to an amount of tension on said rope for restricting rope paying from said rope winder when the amount of tension on said rope is less than a predetermined amount.

11. An auto-sailing system as claimed in claim 10, wherein said braking device comprises a pulley arranged to guide the rope as it is taken in or paid out from the rope winder, a brake shoe, and means for biasing the pulley such that when the tension on said rope is insufficient to overcome a biasing force provided by a bias spring, the bias spring causes the pulley to trap the rope between the pulley and the brake shoe, and such that when the tension on said rope is sufficient to overcome the force of the bias spring, the rope is released and free to pay out form the rope winder.

* * * * *